US007644755B2

(12) United States Patent
Stoesz et al.

(10) Patent No.: US 7,644,755 B2
(45) Date of Patent: Jan. 12, 2010

(54) ANNULAR ELECTRICAL WET CONNECT

(75) Inventors: Carl W. Stoesz, Houston, TX (US); Luis E. Mendez, Houston, TX (US); Walter S. Going, III, Houston, TX (US); Don A. Hopman, Alvin, TX (US)

(73) Assignee: Baker Hughes Incorporated, Houston, TX (US)

( * ) Notice: Subject to any disclaimer, the term of this patent is extended or adjusted under 35 U.S.C. 154(b) by 293 days.

(21) Appl. No.: 11/508,809

(22) Filed: Aug. 23, 2006

(65) Prior Publication Data

US 2008/0047703 A1 Feb. 28, 2008

(51) Int. Cl.
*E21B 17/02* (2006.01)
*H01R 4/60* (2006.01)

(52) U.S. Cl. ..... 166/65.1; 166/242.6; 439/210

(58) Field of Classification Search ..... 166/242.1, 166/65.1, 242.6, 242.7; 439/178, 179, 207, 439/209, 210, 211

See application file for complete search history.

(56) References Cited

U.S. PATENT DOCUMENTS

| | | | | |
|---|---|---|---|---|
| 2,178,931 | A | 11/1939 | Crites et al. | |
| 3,398,392 | A * | 8/1968 | Henderson | 439/201 |
| 4,510,797 | A | 4/1985 | Guidry et al. | |
| 4,806,114 | A | 2/1989 | Hopper | |
| 5,058,683 | A | 10/1991 | Godfrey et al. | |
| 5,294,923 | A | 3/1994 | Juergens et al. | |
| 5,334,801 | A * | 8/1994 | Mohn | 174/47 |
| 5,389,003 | A | 2/1995 | Van Steenwyk et al. | |
| 5,577,925 | A | 11/1996 | Schnatzmeyer et al. | |
| 5,927,402 | A * | 7/1999 | Benson et al. | 166/65.1 |
| 6,123,561 | A | 9/2000 | Turner et al. | |
| 6,186,229 | B1 | 2/2001 | Martin et al. | |
| 6,209,648 | B1 | 4/2001 | Ohmer et al. | |
| 6,286,595 | B1 * | 9/2001 | Oxnevad et al. | 166/242.7 |
| 6,390,193 | B1 | 5/2002 | Martin et al. | |
| 6,439,932 | B1 | 8/2002 | Ripolone | |
| 6,755,253 | B2 | 6/2004 | Smith et al. | |
| 6,776,636 | B1 | 8/2004 | Cameron et al. | |
| 6,902,414 | B2 | 6/2005 | Dopf et al. | |
| 7,364,454 | B2 * | 4/2008 | Brus | 439/441 |
| 7,475,734 | B2 | 1/2009 | O'Malley et al. | |
| 2003/0211768 | A1 * | 11/2003 | Cameron et al. | 439/191 |

(Continued)

OTHER PUBLICATIONS

Kogure, E., et al., "Application of a near surface disconnectable drilling riser in deepwater", IADC/SPE 47828, Sep. 1998. 1-7.

(Continued)

*Primary Examiner*—Kenneth Thompson
(74) *Attorney, Agent, or Firm*—Steve Rosenblatt

(57) ABSTRACT

A connector is made up downhole and can connect electrical signal or power circuits. The male component features one or more circumferential bands on the exterior and the female component features like bands on its interior. The bands are preferably covered with removable sleeves until the connection is made up. In the preferred embodiment, the sleeves push each other out of the way as the connection is made up. The bands are preferably cylindrically shaped on their respective supporting connection half to make easy and reliable contact when the connection halves are advanced together without need for rotation to get the desired contact. Seals surround the connected contacts after makeup to keep out well fluids.

18 Claims, 3 Drawing Sheets

U.S. PATENT DOCUMENTS

| | | | | |
|---|---|---|---|---|
| 2004/0159444 | A1* | 8/2004 | Wolters et al. | 166/381 |
| 2004/0242044 | A1* | 12/2004 | Head | 439/190 |
| 2007/0144746 | A1* | 6/2007 | Jonas | 166/380 |

OTHER PUBLICATIONS

Luft, H.B., et al., "Development of a New Spoolable Mechanical Coiled Tubing Connector", SPE 89527, Mar. 2004, 1-9.

Pallini, J.W., et al, "Partial Turn Threaded Connector for Offshore Casing, Conductor, and Pile Joints", SPE 16667, Sep. 1987, 173-179.

Bjornstad, B., et al., "Fibre Optic Well Monitoring System", SPE 23147, Sep. 1991, 425-432.

Corbett, Gary, et al., "Fiber Optic Monitoring in Openhole Gravel pack Completions", SPE 77682, Sep. 2002, 1-14.

* cited by examiner

ANNULAR ELECTRICAL WET CONNECT

FIELD OF THE INVENTION

The field of this invention is connections that can be made up downhole in a wet environment to connect power or signal circuits.

BACKGROUND OF THE INVENTION

Sensors and a variety of downhole tools require power input and transmit signals to the surface via electrical circuits. Some occasions require a connection downhole to complete such circuits. Apart from completing electrical power and signal transmission circuits connections also need to be completed downhole that will provide continuity to control line circuits or tubulars through which a fiber optic cable can be run for a variety of functions.

One style of wet connectors for electrical applications involves a male component with an exterior contact band and a female counterpart component with a band on an interior surface. The portion of the string left in the well has a first hub generally with the female component looking up. The string run in from the surface has a second hub with the male component extending down longitudinally. The hub being run in is rotationally oriented as it advances toward the female hub so that the banded male and female components line up before being pushed together until the electrical contacts on each are opposite each other to complete the circuit. Some examples are U.S. Pat. Nos. 6,439,932 and 4,510,797. Wet connectors that complete tubing circuits in a similar manner are illustrated in U.S. Pat. Nos. 6,755,253; 6,390,193 and 6,186,229. Some connectors combine connection of electrical lines and hydraulic lines as illustrated in U.S. Pat. No. 6,209,648. Wet connectors for wireline that involve an indexing feature without a main bore in the connection are illustrated in U.S. Pat. No. 5,058,683.

Some connectors involve a polished bore receptacle and a string that is inserted into it. The receptacle has a button extending radially into the bore and the string has on its exterior a circumferential ring that is an open scroll with bent up edges. When the string is fully inserted into the polished bore receptacle the central conduit is joined and the bent tabs are said to find the button to make electrical contact in the polished bore with no need for rotational alignment. This design is illustrated in U.S. Pat. No. 5,577,925.

What is needed and provided by the present invention is a wet connector that features one or more circumferential conductive bands wrapped around the outside of the male component and the inside of the female component for assured contact when they become axially aligned without the need for any rotational orientation. The contact can occur virtually continuously over 360 degrees or a lesser angle, if desired. Projecting components that can break off on the trip downhole to where the connection is made are avoided in favor of cylindrical mating contact surfaces for a more reliable connection. The contacts can be covered for run in to protect them from well fluids and mechanical harm during run in and until the connection is made. In the preferred embodiment, the act of making the connection displaces the protective sleeves from both halves of the connection just as the connection is made. Seals keep fluid out of the contact area when the contacts are in alignment. These and other advantages of the present invention will become more apparent to those skilled in the art from a review of the description of the preferred embodiment and the associated drawings while the full scope of the invention can be appreciated from the appended claims.

SUMMARY OF THE INVENTION

A connector is made up downhole and can connect electrical signal or power circuits. The male component features one or more circumferential bands on the exterior and the female component features like bands on its interior. The bands are preferably covered with removable sleeves until the connection is made up. In the preferred embodiment, the sleeves push each other out of the way as the connection is made up. The bands are preferably cylindrically shaped on their respective supporting connection half to make easy and reliable contact when the connection halves are advanced together without need for rotation to get the desired contact. Seals surround the connected contacts after makeup to keep out well fluids.

DETAILED DESCRIPTION OF THE DRAWINGS

DETAILED DESCRIPTION OF THE PREFERRED EMBODIMENT

Figure 1:
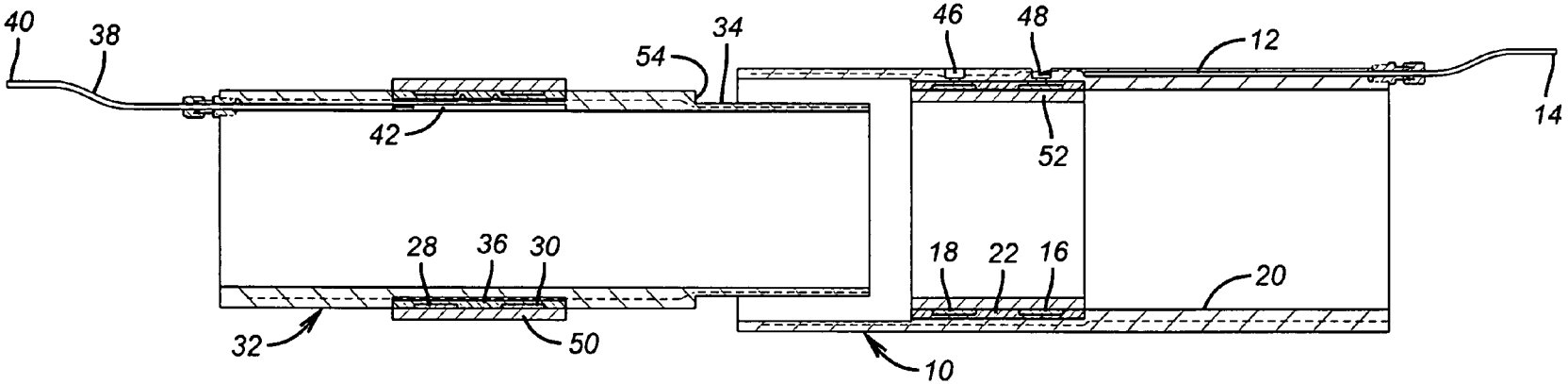
FIG. 1 is a run in view just short of the connection being made.
Figure 3:
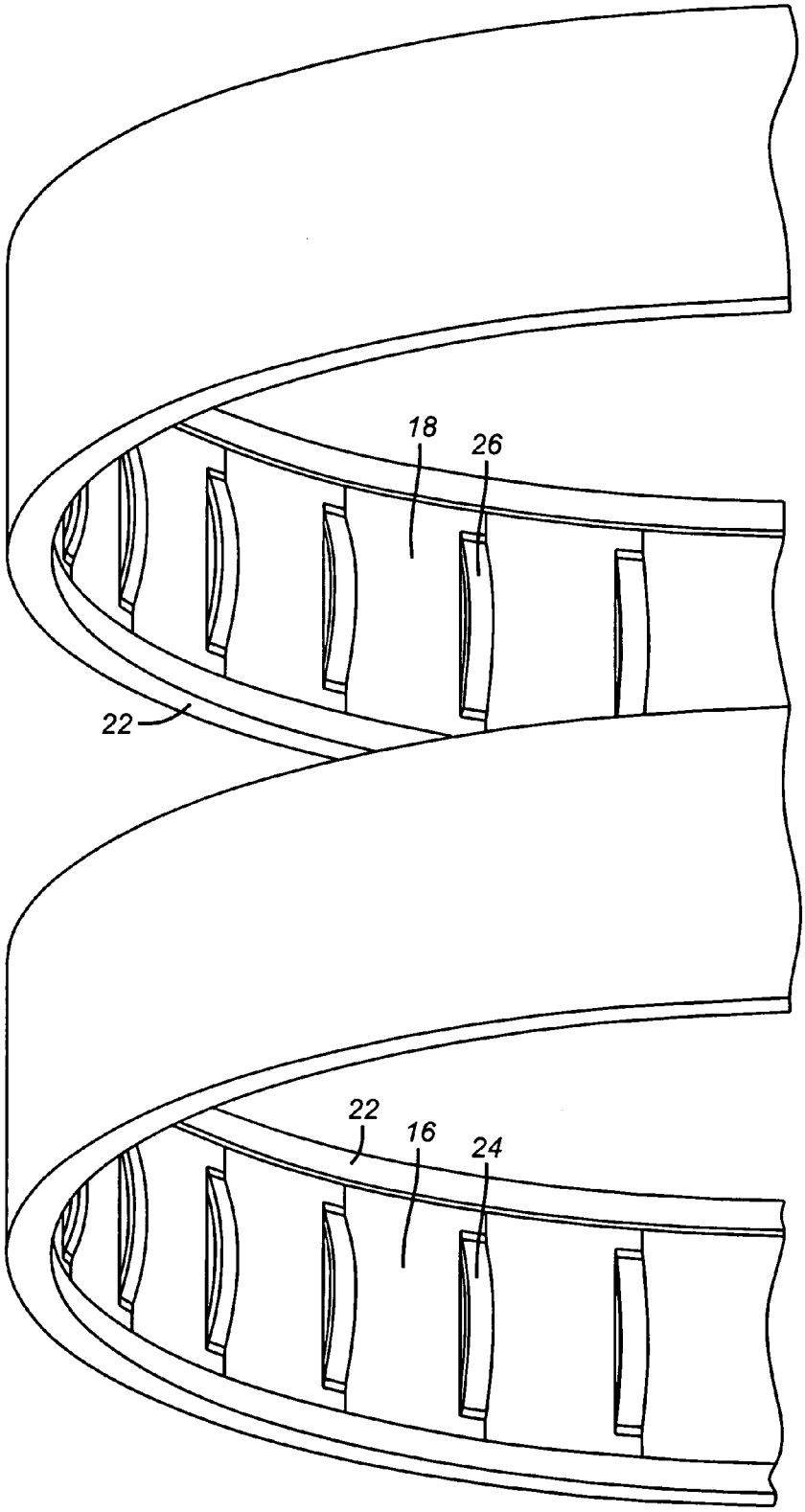
FIG. 3 is a close up view of the contacts on the female component indicating the bow springs that aid in making contact.

Referring to FIG. 1, the portion of the connection that is supported downhole, only a portion of which is shown is referred to as 10. Typically a downhole packer or anchor would support what will be referred to as the female portion of the connection 10. It comprises one or more electrical lines 12 that can further comprise power and/or signal line that is preferably run in a longitudinal bore in the female portion 10 but is shown schematically in FIG. 1. Line 12 runs to a sensor or a powered instrument or an electrically operated tool or other downhole device at end 14 and such devices are omitted for clarity. Contacts 16 and 18 are mounted to the inner wall 20 of female portion 10 on top of insulating material 22. Contacts 16 and 18 at least 180 degrees and preferably run for 360 degrees along wall 20 and a portion of the 360 degree run is shown for two contacts 16 and 18. In FIG. 3 the insulating material 22 is shown in discrete sections for each contact but could alternatively be continuous between them. The contacts 16 and 18 can optionally have bow springs 24 and 26. The purpose of the bow springs 24 and 26 is to span any gap with a mating contact such as 28 and 30 that are mounted on male component 32 on its outer wall 34 and isolated electrically from it by insulator 36. Line 38, which can be electric or signal or another type of conductor runs from end 40 which is normally at the surface and through a passage in male component 32. An internal wall opening 42 is provided in male component 32 to allow making connections to the contacts 28 and 30 after which the opening is closed off in a fluid tight manner in ways known in the art. Similarly, openings 46 and 48 provide access to contacts 18 and 16 for connecting line 12 after which they are plugged in a manner known in the art.

Figure 2:
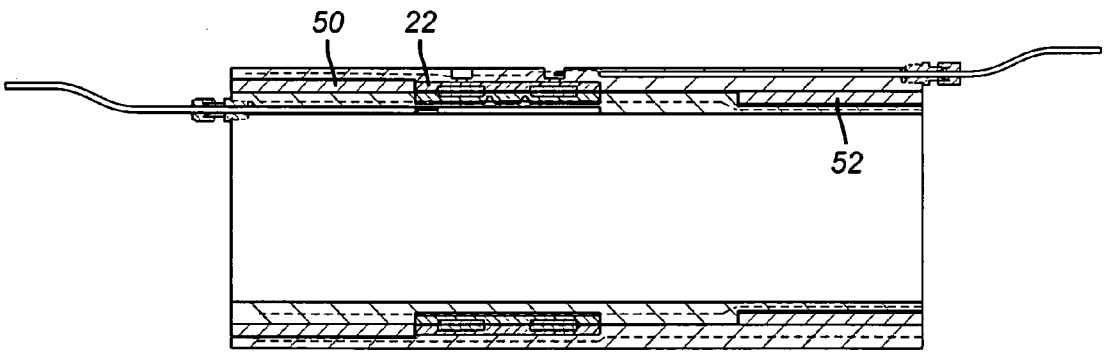
FIG. 2 is the view of FIG. 1 with the connection made up.
Figure 4:
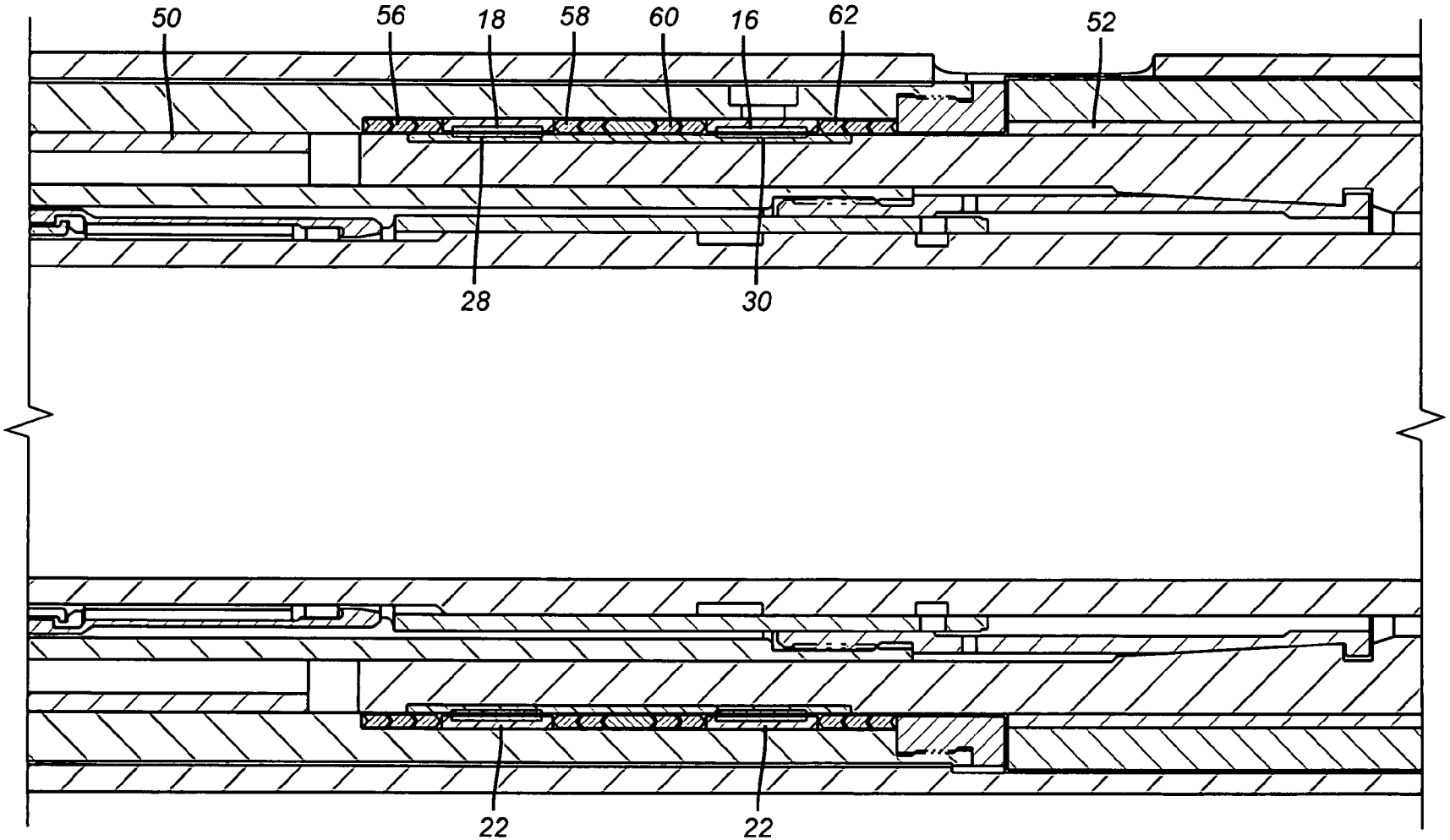
FIG. 4 is a detailed view of the connection made up showing the adjacent packer components.

Contacts 28 and 30 are covered during run in by a removable sleeve 50 that is shown covering the contacts in FIG. 1 and displaced when it engages insulator 22 on the female portion 10, as shown in FIG. 2. Similarly contacts 16 and 18 are initially covered with a sleeve 52 until it gets knocked away with contact from shoulder 54 as the connection is made up in FIG. 2. Alternatively the sleeves can knock each other off during makeup. FIG. 4 shows the displaced position of sleeves 50 and 52 when the connection is fully made up. FIG. 4 shows contacts 18 and 16 aligned with contacts 28 and 30. Further, seals pairs 56 and 58 isolating contacts 18 and 28 from contact with well fluids as well as seal pairs 60 and 62 isolating contact pairs 16 and 30 from contact with well fluids once the connection is made up. Seals 58 and 60 could optionally be omitted and the discrete insulator segments 22 can instead run continuously between the contacts 16 and 18. The seals described above could alternatively be on the male component 32 instead of the female component 10 or alternatively the seals could be on both components or neither.

Those skilled in the art will also appreciate the contacts 16 and 18 shown in FIG. 3 with bow springs 24 can also be illustrative of the surface appearance of mating contacts 28 and 30. The bow springs 24 can appear on contacts on the male component 32 or the female component 10 or contacts on both or neither. The surfaces of the contacts can be cylindrical with preferably a slight interference fit between the mating contacts so that they will firmly engage when pushed into alignment for good continuity.

While the displacement of the protective sleeves 50 and 52 preferably occurs at the point shortly before the opposing contacts align by virtue of pushing the connection halves together, other ways to remove the sleeves are also contemplated such as chemical degradation, applied pressure or mechanical actuation such as shiftable sleeves or j-slot mechanisms to name a few.

While two contacts on each half have been described, those skilled in the art will appreciate that fewer or greater numbers of contacts on each half with equal or unequal spacing on each half can be used to make one or a plurality of connections upon joint makeup. Those skilled in the art will appreciate that the components 10 and 32 when fully advanced for alignment of the contacts, will lock together to retain the contact using a locking device that is known in the art and therefore not shown for greater clarity of presentation of the invention. Some of these devices include locking collets or dogs or bayonet type connections.

With the contacts extending for a full 360 degrees on components 10 and 32 orientation devices are not necessary. In fact, each component can extend for a few degrees over 180 and adequate contact can still be made without rotational orientation on makeup.

The sleeves 50 and 52 keep the contacts clean of well fluid until just before complete assembly. The seals 56-62 take over after the sleeves are pushed out of the way and contact is made for the respective contact pairs to seal well fluids from getting to contact pairs such as 18 and 28 and 16 and 30 shown connected in FIG. 4.

The above description is illustrative of the preferred embodiment and many modifications may be made by those skilled in the art without departing from the invention whose scope is to be determined from the literal and equivalent scope of the claims below.

We claim:

1. A tubular connector for makeup downhole, comprising:

a tubular female component comprising a flow passage therethrough and at least one electrical contact fixedly mounted to said female component adjacent an inner wall that defines said passage;

a tubular male component comprising a flow passage therethrough and at least one electrical contact fixedly mounted to said male component adjacent an outer wall thereof;

said contacts when exposed and axially aligned defining an annular gap therebetween;

said passages remaining open after said components are joined;

at least one of said contacts comprise at least one conductive resilient member selectively extending radially from said fixedly mounted portion of said contact to bridge said annular gap, after said contact and said resilient member are exposed;

a removable cover on a contact on at least one of said components.

2. The connector of claim 1, wherein:

bringing the male and female components together removes said cover.

3. The connector of claim 2, wherein:

a contact on both male and female components comprises a removable cover.

4. The connector of claim 3, wherein:

a shoulder on said male component removes said cover from the contact on the female component and a shoulder on the female component removes said cover from the contact on the male component.

5. The connector of claim 3, wherein:

said covers are removed chemically, with pressure or by an applied mechanical force to expose contacts on said male and female components before they are aligned.

6. The connector of claim 1, wherein:

said contacts on said male and female components extend circumferentially at least over 180 degrees.

7. The connector of claim 1, wherein:

said resilient member comprises a bow spring.

8. The connector of claim 6, wherein:

said contacts comprise cylindrically shaped mating contact faces.

9. A tubular connector for makeup downhole, comprising:

a tubular female component comprising a passage therethrough and at least one electrical contact adjacent an inner wall that defines said passage;

a tubular male component comprising a passage therethrough and at least one electrical contact adjacent an outer wall thereof;

at least one of said contacts comprise at least one conductive resilient member;

a removable cover on a contact on at least one of said components;

wherein bringing the male and female components together removes said cover; and a contact on both male and female components comprises a removable cover;

said covers engage as said components are brought together to expose contacts on said male and female components.

10. A tubular connector for makeup downhole, comprising:

a tubular female component comprising a flow passage therethrough and at least one electrical contact adjacent an inner wall that defines said passage;

a tubular male component comprising a flow passage therethrough and at least one electrical contact adjacent an outer wall thereof;

said passages remaining open after said components are joined;

at least one of said contacts comprise a plurality of conductive resilient elongated members at spaced locations from each other and generally axially aligned with an axis of said flow passage;

said contacts on said male and female components and said conductive resilient member continuously exposed for electrical contact while said contacts extend circumferentially at least over 180 degrees.

11. A tubular connector for makeup downhole, comprising:

a tubular female component comprising a flow passage therethrough and at least one electrical contact adjacent an inner wall that defines said passage;

a tubular male component comprising a flow passage therethrough and at least one electrical contact adjacent an outer wall thereof;

said passages remaining open after said components are joined;

at least one of said contacts comprise at least one conductive resilient member;

said contacts on said male and female components and said conductive resilient member continuously exposed for electrical contact while said contacts extend circumferentially at least over 180 degrees;

said resilient member comprises a bow spring.

12. The connector of claim 10, wherein:

said contacts comprise cylindrically shaped mating contact faces.

13. A tubular connector for makeup downhole, comprising:

a tubular female component comprising a flow passage therethrough and at least one electrical contact adjacent an inner wall that defines said passage;

a tubular male component comprising a flow passage therethrough and at least one electrical contact adjacent an outer wall thereof;

said passages remaining open after said components are joined;

at least one of said contacts comprise at least one conductive resilient member;

said contacts on said male and female components and said conductive resilient member continuously exposed for electrical contact while said contacts extend circumferentially at least over 180 degrees;

a removable cover on a contact on at least one of said components.

14. The connector of claim 13, wherein:

bringing the male and female components together removes said cover.

15. The connector of claim 14, wherein:

a contact on both male and female components comprises a removable cover.

16. The connector of claim 15, wherein:

a shoulder on said male component removes said cover from the contact on the female component and a shoulder on the female component removes said cover from the contact on the male component.

17. A tubular connector for makeup downhole, comprising:

a tubular female component comprising a passage therethrough and at least one electrical contact adjacent an inner wall that defines said passage;

a tubular male component comprising a passage therethrough and at least one electrical contact adjacent an outer wall thereof;

at least one of said contacts comprise at least one conductive resilient member;

said contacts on said male and female components extend circumferentially at least over 180 degrees;

a removable cover on a contact on at least one of said components;

bringing the male and female components together removes said cover;

a contact on both male and female components comprises a removable cover;

said covers engage as said components are brought together to expose contacts on said male and female components.

18. The connector of claim 15, wherein:

said covers are removed chemically, with pressure or by an applied mechanical force to expose contacts on said male and female components before they are aligned.

* * * * *